United States Patent [19]

Juh

[11] 4,187,785

[45] Feb. 12, 1980

[54] PORTABLE TABLE

[76] Inventor: Yang R. Juh, 193 Ta-Lung St., Taipei City, Taiwan

[21] Appl. No.: 844,054

[22] Filed: Oct. 20, 1977

[51] Int. Cl.[2] ..... A47B 3/08

[52] U.S. Cl. ..... 108/36; 190/12 R

[58] Field of Search ..... 108/36, 35, 34, 33, 108/38, 132, 129; 190/11, 12 A, 12 R

[56] References Cited

U.S. PATENT DOCUMENTS

| | | | |
|---|---|---|---|
| 1,201,903 | 10/1916 | Wiley | 18/129 X |
| 2,358,883 | 9/1944 | Rothschild | 108/35 X |
| 2,609,072 | 9/1952 | Levinson | 108/33 X |
| 3,097,028 | 7/1963 | Pieschel | 108/129 X |
| 3,298,478 | 1/1967 | Soprani | 108/132 X |
| 3,628,471 | 12/1971 | Burr | 108/132 |

FOREIGN PATENT DOCUMENTS

| | | | |
|---|---|---|---|
| 1237634 | 6/1960 | France | 108/34 |

*Primary Examiner*—Francis K. Zugel

*Attorney, Agent, or Firm*—Cushman, Darby & Cushman

[57] ABSTRACT

A collapsable table having first and second table bodies hinged together along an upper edge thereof. Leg members are pivotably connected to opposite side walls of the first body so that the legs may support both bodies, one closed upon the other, when the table is open, and may also be folded through slots in the sidewalls into the first table body when the table is not in use. When the table is open, the legs are secured by fasteners which extend through the respective legs into the sidewalls of the second table body. Fasteners on the sidewalls hold the table bodies in the closed position.

4 Claims, 6 Drawing Figures

PORTABLE TABLE

BACKGROUND OF THE INVENTION

The unique device of this invention is the collectable legs.

Description of the Prior Art:

Usually, table legs are foldable, in stead of collectable.

SUMMARY OF THE INVENTION

Body of the table is constituted by the body of case (a) and (b). One end of table legs is covered with bushing and fixed to the body of the table, so that the table legs may be turned outward from the space between table body (case body) (a) and (b). As soon as the table is erected, turn the table legs outward from the space between table body (case body) (a) and (b), then fix the legs with screws. In case legs are to be collected, collect the legs to the space between the table body (case body) (a) and (b). As there is a handle on the table body (case body), the table may be carried.

(i) Table legs (made of round or square metal pipes)

(j) Drawer (k) Hinge (l) Opening for screws on table leg.

(↑ ↓) Direction of movement

Figure 6:
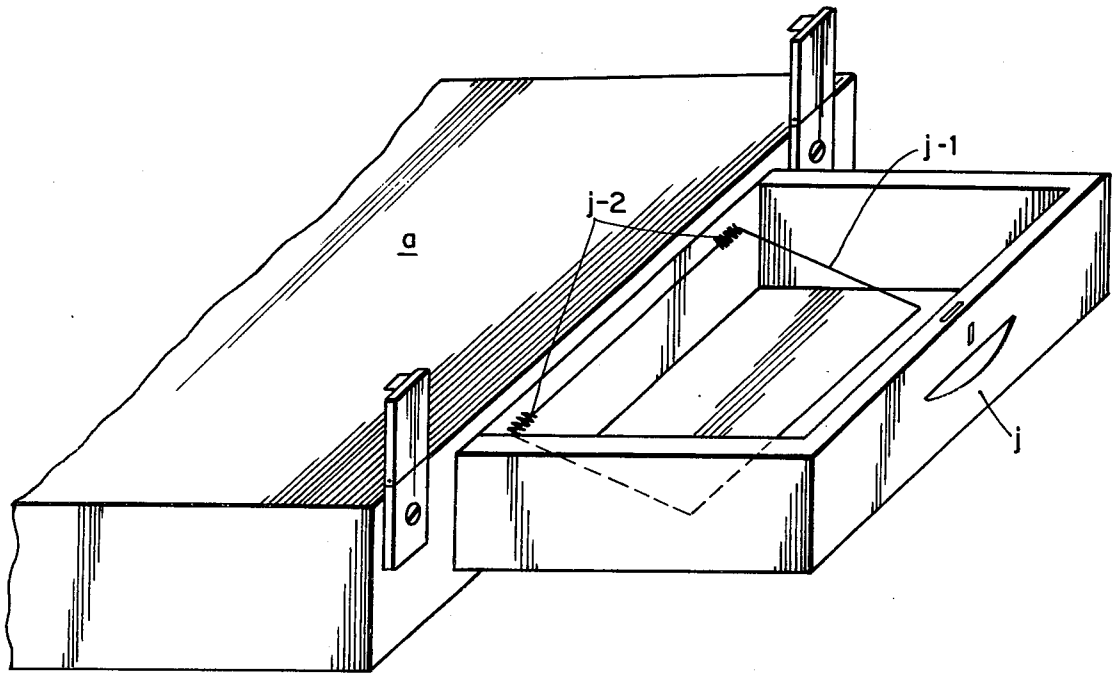

FIG. 6 Drawer (j) is in table body (case body) a. In the drawer, there is a iron wire in square shape (j)-1, and spring device (j)-2. The latter keeps the former always on the bottom of the drawer. When the iron wire is pulled up, the elastity will keep the iron wire returning to the bottom of the table. Pull up the iron wire (j)-1 before articles are put in the drawer. The iron wire will hold the articles and therefore the articles will properly fixed when the table is carried. Description of the Preferred Embodiment(s)

(1) Table in case shape (drawing 1) is unpacked into the shape like drawing (5).

(2) In drawing (5), table body a and b are separated. Erect the table leg (i) and then put table body a and table body b together. Put screws (h) in the openings on table legs (i), and fasten the screws to the nuts (g) on both sides of table body a.

(3) Turn the whole table to the right position as shown in drawing (2).

Figure 1:
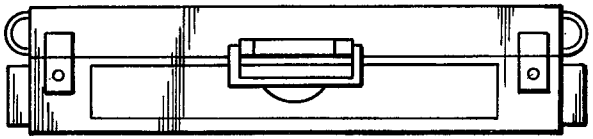
FIG. 1 Legs are collected into a table body, and the table becomes a case.
Figure 2:
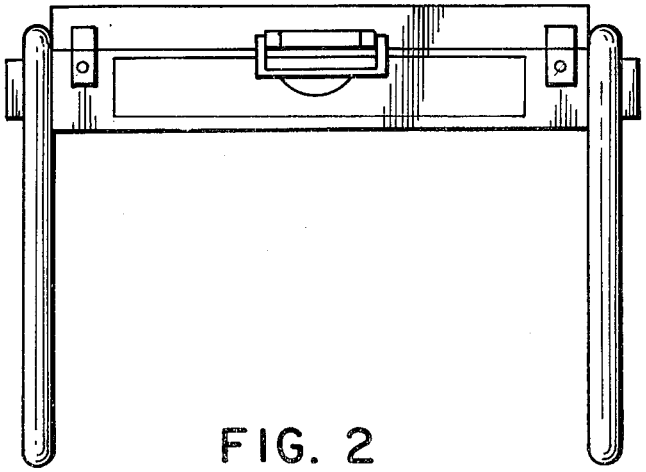
FIG. 2 Front view of erected table
Figure 3:
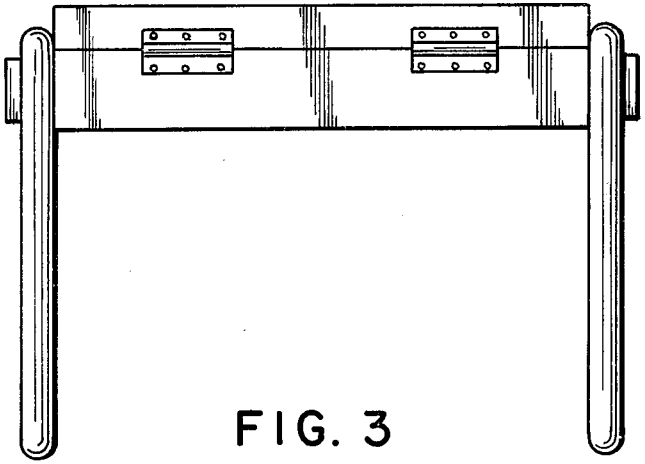
FIG. 3 Rear view of erected table
Figure 4:
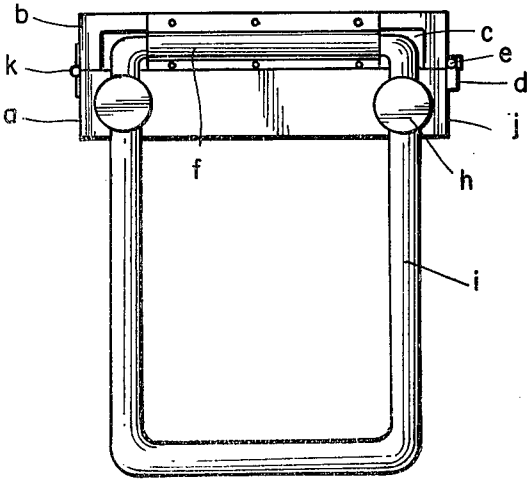
FIG. 4 Side view of erected table
Figure 5:
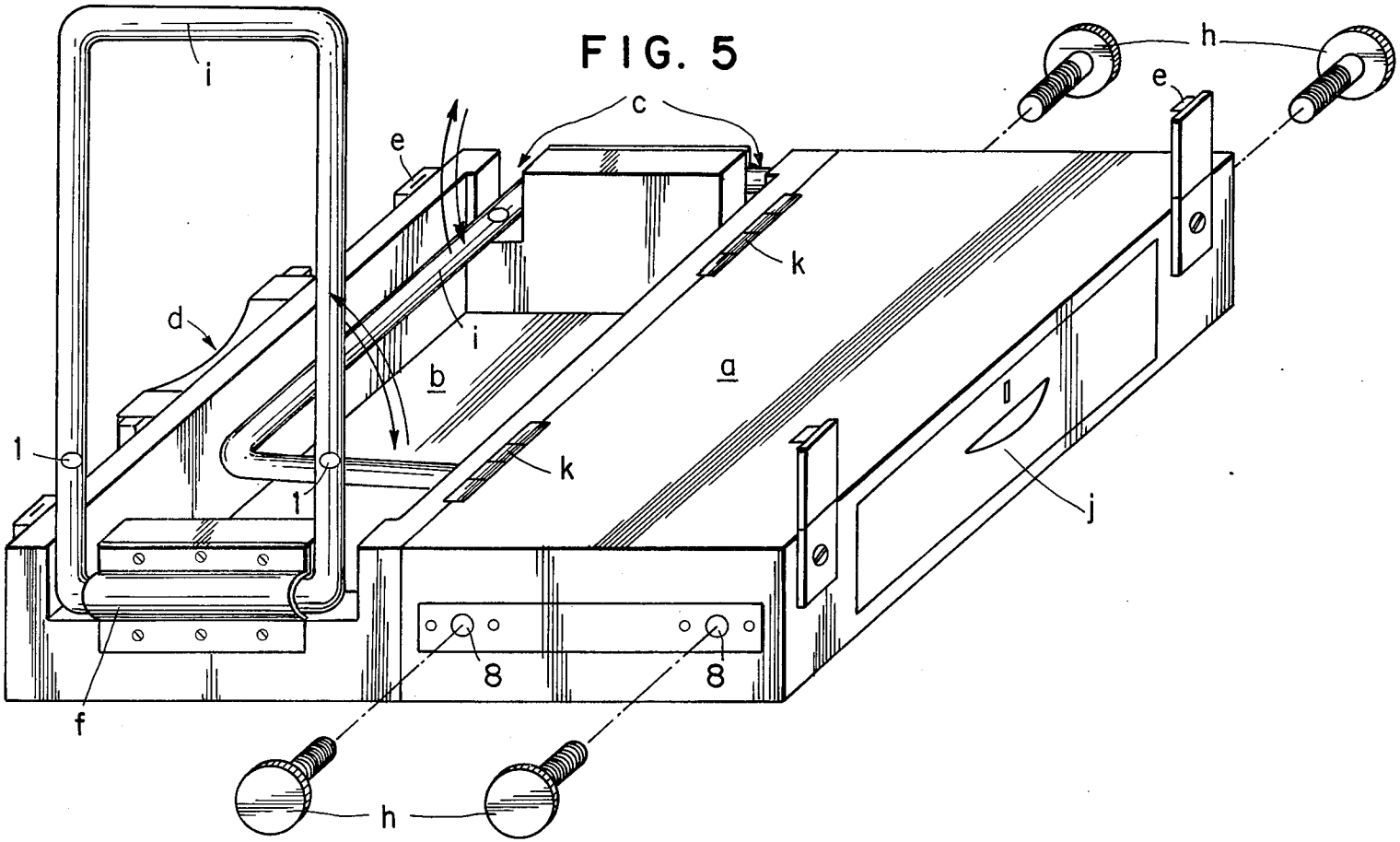
FIG. 5 Description of Structure (a) Table body a (b) Table body b (c) Opening of table body b (d) Handle (e) Fastener (f) Bushing of table leg (g) Screw nuts, fixed on table body a (h) Screws, used to fix table legs.

(4) To collect the table, take off screws (h), open fasteners (e), separate table body a and b, put table legs (i) inside table body b, then close table body a and b. At last, fasten the fasteners and the table will become a case. Referring to FIG. 5, wherein the portable table structure is shown, the table consists primarily of two table bodies a and b, each having a bottom and four sidewalls which extend upward from the interior surface of the bottom to an edge. The bodies a and b are hinged together along one side wall of each body, by one or more suitable hinges k which allows movement of the bodies between a closed position, in which respective edges of the two bodies a and b are in contact (as shown in FIGS. 1, 2, 3, and 4), and an open position (as shown in FIG. 5). Two leg members i, each having two separated and downwardly extending legs are pivotably connected by bushings f to the outsides of the opposite sidewalls of body b. Each pair of leg members is connected together along their pivotal connection f. Each of the leg member connected sidewalls has slots c which permit the leg members i to move between a position supporting bodies a and b in their closed position (as shown in FIGS. 2, 3 and 4) to a position with body b (as best shown in FIG. 5). In order to provide rigidity to the leg members i when they support bodies a and b in their closed position, removable fastening means for fastening each of the legs to a sidewall of body a are provided. Such means are suitably composed of screw nuts g, suitably fixed to the sides of body a, screw holes 1,suitably located on each leg of leg members i to align with nuts g, and screws g. Fasteners e, fixed to the side walls of bodies a and b opposite to sidewalls which support hinge f, are included for holding bodies and and b in a closed position.

I claim:

1. A collapsable table comprising: a first table body having a bottom and side walls each extending upward from the interior surface of said bottom to an edge;

a second table body having a bottom and side walls each extending upward from the interior surface of the bottom of said second body to an edge;

hinge means pivotably connecting said first and second bodies along an edge of each for movement between an open position in which the interior of said first body is accessible for receiving leg members to be stored, and a closed position in which respective edges of said first and second bodies are in contact;

first and second leg members pivotably connected to opposite side walls of said first body along the outside thereof for movement between a position supporting said bodies in said closed position to a position substantially within said first body, said opposite side walls having slots therein for permitting said pivotable movement of said leg members into said first body and said leg members each comprising two separated and downwardly extending legs connected together along their pivotal connection to said side walls; and removable fastener means for fastening each of said legs to a side wall of said second table body along the outside thereof when said bodies are in closed position.

2. A table as in claim 1, further including fastener means on side walls of said bodies for holding said bodies in said closed position.

3. A table as in claim 1, further including a drawer in said second body.

4. A table as in claim 3, including a wire and spring in said drawer for holding objects in said drawer in place when said bodies are in said closed position.

* * * * *

UNITED STATES PATENT AND TRADEMARK OFFICE

CERTIFICATE OF CORRECTION

PATENT NO. : 4,187,785

DATED : February 12, 1980

INVENTOR(S) : RONG JUH YANG

It is certified that error appears in the above–identified patent and that said Letters Patent are hereby corrected as shown below:

Please correct the inventor's last name to read:

--YANG--

Signed and Sealed this

*Fifteenth* Day of *July 1980*

[SEAL]

*Attest:*

SIDNEY A. DIAMOND

*Attesting Officer*

*Commissioner of Patents and Trademarks*